United States Patent [19]

Baum

[11] Patent Number: 4,598,613

[45] Date of Patent: Jul. 8, 1986

[54] CHAMPAGNE BOTTLE OPENER

[76] Inventor: Frederick W. Baum, 22710 Oxnard St., Woodland Hills, Calif. 91361

[21] Appl. No.: 759,950

[22] Filed: Jul. 29, 1985

[51] Int. Cl.[4] ..... B67B 7/32

[52] U.S. Cl. ..... 81/3.37; 81/3.55

[58] Field of Search ..... 81/3.36, 3.37, 3.29, 81/3.55, 3.56, 3.47, 3.48; 29/267

[56] References Cited

U.S. PATENT DOCUMENTS

| | | | |
|---|---|---|---|
| 280,697 | 7/1883 | White | 81/3.37 |
| 2,761,338 | 9/1956 | Hardy | 81/3.29 |
| 4,074,411 | 2/1978 | Willard et al. | 29/267 |
| 4,354,375 | 10/1982 | Lesowsky | 29/267 |

*Primary Examiner*—James L. Jones, Jr.

*Attorney, Agent, or Firm*—Pretty Schroeder Brueggemann & Clark

[57] ABSTRACT

A device for controllably removing a stopper from a bottle, such as a champagne bottle, so as to prevent the uncontrolled discharge of the stopper from the bottle opening. The device has a brace means selectively securable to a portion of the bottle beneath the stopper, chuck means or alternatively a socket for engaging the stopper, and actuator means operatively connected to the brace means and chuck means or socket for raising the chuck means or socket relative to the brace and thereby removing the stopper from the bottle. The chuck means and stopper securely engage the stopper and thereby prevent its uncontrolled discharge from the bottle opening.

23 Claims, 13 Drawing Figures

FIG. 1.
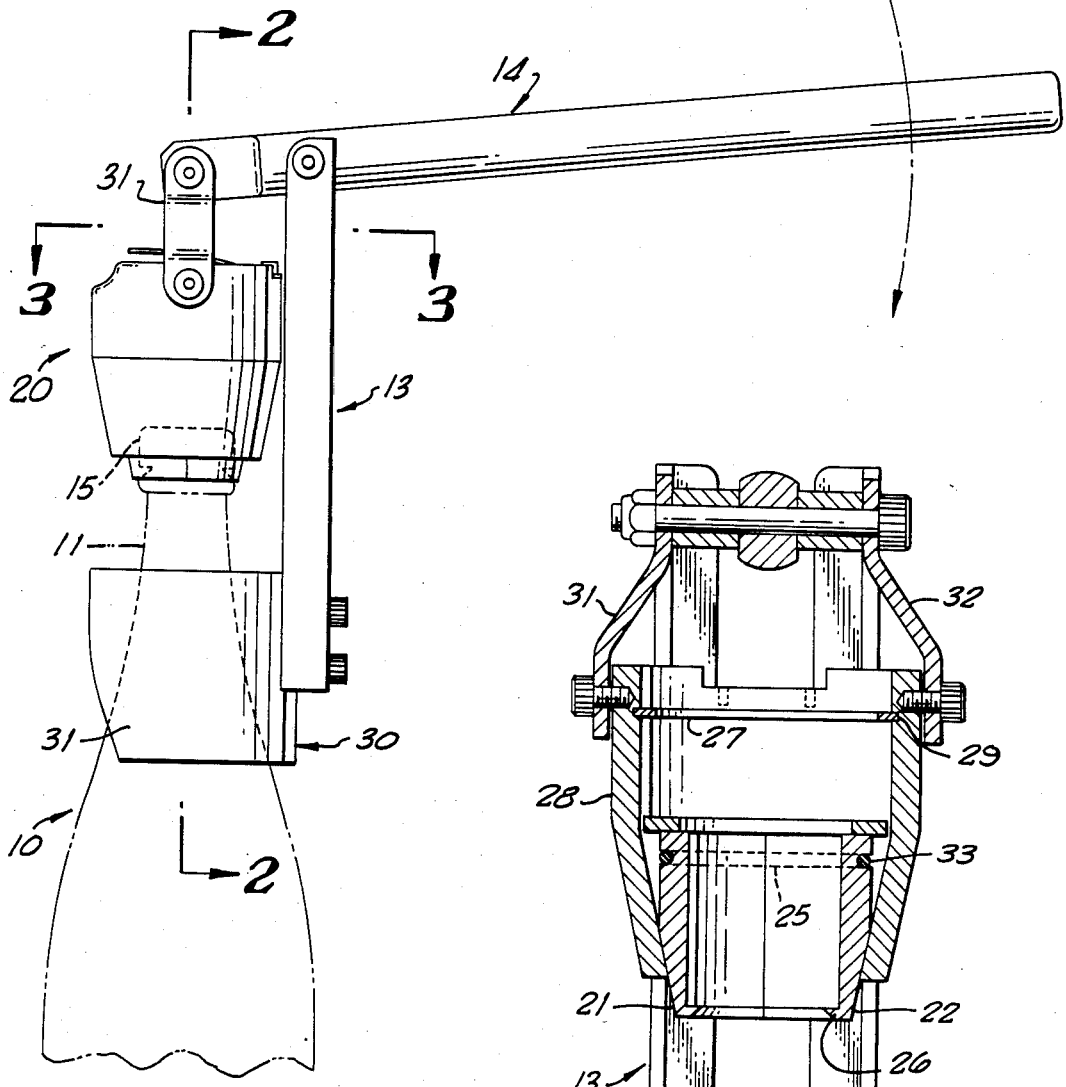
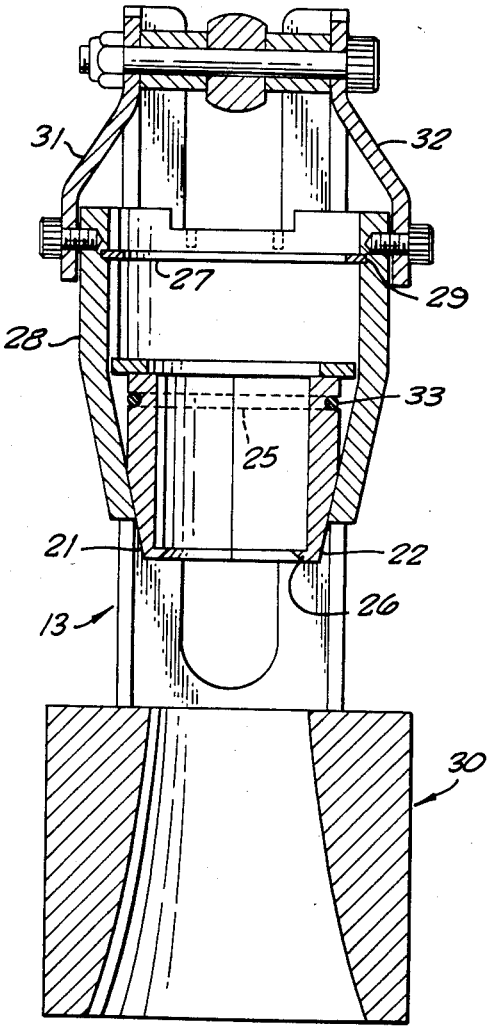
FIG. 2.
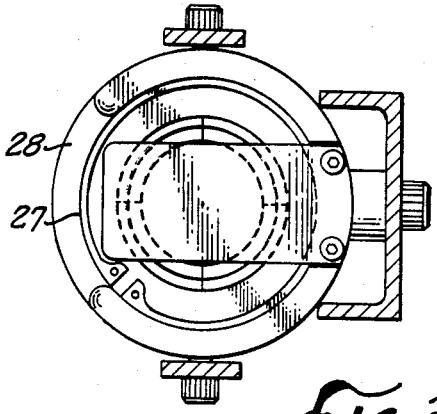
FIG. 3.

CHAMPAGNE BOTTLE OPENER

FIELD OF THE INVENTION

This invention relates generally to a device for removing a stopper from a bottle such as a champagne bottle, and, more particularly, to a device for controllably removing the stopper from the bottle so as to prevent uncontrolled discharge of the stopper.

BACKGROUND OF THE INVENTION

Champagne and other sparkling wines (hereinafter referred to generally as champagne) have long been associated with celebration. Too often, however, the excitement of the event is dispelled by problems associated with opening the champagne.

As champagne ferments, it generates a natural pressure within the bottle. This internal pressure can, under certain circumstances such as shaking or high temperature, become so great that the stopper will forcefully discharge from the bottle. For this reason, bottlers of champagne traditionally place a wire restraint or metal cap around the stopper and the bottle neck to secure the stopper in place. Most commonly, the stopper will remain in place after the wire restraint is removed.

Until recently, champagne bottles were sealed with cork stoppers. Cork, however, has a tendency to split and small particles can break off into the champagne. Recently, the trend has been to use plastic stoppers to seal the bottle. The plastic stopper is relatively inexpensive and is machine-adapted to give a tight and secure seal. Stoppers of either the cork or plastic variety may be of a generally cylindrical shape having smooth side walls or the stopper can have a downwardly-facing annular shoulder.

It is possible with some practice to remove the stopper from a champagne bottle without the aid of a specialized device by prying or rocking the stopper upward with the thumbs. As the stopper works free, however, the internal pressure of the champagne can cause the stopper to be discharged, possibly injuring onlookers. Moreover, at large events, such as weddings, or in commercial establishments where many champagne bottles may be opened at a single time, use of thumbs in this manner is not desirable.

On occasion one may desire to reseal the bottle and store the champagne for later use. After the bottle has been opened for the first time, however, the pressure in the bottle is substantially reduced. Consequently, increasingly more effort is required to remove the stopper from the bottle after the bottle has been resealed.

It is the object of the present invention to provide a champagne bottle opener which allows for the controlled removal of the stopper so as to prevent uncontrolled discharge of the stopper from the bottle opening.

It is further the object of the present invention to provide a champagne bottle opener which can easily and effortlessly open a bottle having either a smooth side wall or downwardly-facing shoulder.

SUMMARY OF THE INVENTION

The present invention provides a device which can controllably remove a stopper from a bottle, whether the stopper has a smooth side wall or a downwardly-facing shoulder, in such a manner so as to prevent the uncontrolled discharge of the stopper. The device is comprised of brace means selectively securable to a portion of the bottle beneath the stopper, chuck means for engaging the stopper, and actuator means operatively connected to the brace means and chuck means for raising the chuck means relative to the brace means amd thereby removing the stopper from the bottle.

The brace means can be a ringed structure having a tapered opening conforming generally to the shape of the bottle. Alternatively, the brace can be of a semi-circular or "C" shape so long as the opening has a diameter less than the maximum diameter of the bottle. The brace means also has a post to which the actuator means is connected.

The chuck means has a plurality of opposing radially-moveable jaws which encircle the stopper. The jaws can have an inwardly-protruding lip or alternatively a friction inner surface for engagement with the stopper. A collar encircles the jaws. Vertical movement of the collar relative to the jaws urges the jaws radially inwardly to engage the stopper. The inner surface of the collar and the outer surface of the jaws may be tapered so as to allow for easy movement of the collar relative to the jaws.

In one embodiment, the chuck means is pivotably connected to the actuator means such that vertical movement of the actuator causes the collar to move upwardly relative to the brace means which initially urges the jaws radially inwardly to engage the stopper and to subsequently remove the stopper from the bottle. In an alternative embodiment, the jaws are pivotably connected to the actuator means. In this embodiment, the collar is initially slid downwardly over the jaws which urges the jaws radially inwardly. The jaws are then raised upward relative to the brace means by the actuator means thereby removing the stopper from the bottle.

In yet another embodiment of the invention, a socket having a cylindrical upper portion and a semi-circular lower portion is provided for use with stoppers having a downwardly-facing annular shoulder. The lower portion has an inwardly-protruding annular lip for engagement with the shoulder of the stopper.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 1 is a side view of one bottle opener embodiment of the present invention, shown with the opener's chuck engaging the stopper of a bottle.

FIG. 2 is an enlarged cross-section of the bottle opener taken along lines 2—2 in FIG. 1.

FIG. 3 is a sectional view of the bottle opener taken along lines 3—3 in FIG. 1.

DESCRIPTION OF THE PREFERRED EMBODIMENT

Figure 4:
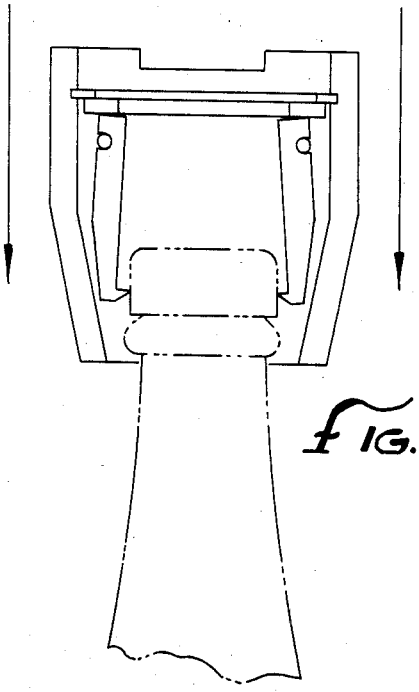
FIG. 4 is a diagrammatic illustration of the embodiment of FIG. 1 showing the chuck being positioned over the stopper.

With reference now to the illustrative drawings, there is shown a device for use in easily and conveniently removing a stopper 15 from a champagne bottle 10 or the like, without risk of the stopper being uncontrollably discharged by high pressure within the bottle. The difficulties encountered in opening a champagne bottle vary depending upon the amount of pressure within the bottle. When the internal pressure is high, usually before the bottle has been opened for the first time, the stopper has a tendency to discharge forcefully from the bottle opening after the wire restraint is removed and the stopper is loosened. When the bottle has been opened on a previous occasion and the stopper subsequently replaced, removal of the stopper becomes increasingly difficult because of the loss of the internal pressure within the bottle. In the present invention a device is provided which controllably removes the stopper from a champagne bottle whether the stopper has a smooth side wall or a downwardly-facing shoulder, and prevents the forceful discharge of the stopper when the internal pressure within the bottle is high.

In one embodiment of the present invention (FIGS. 1–7) a chuck 20 is provided which tightly engages the portion of the stopper 15 protruding above the bottle opening. The bottle 10 is secured in place below the chuck by a brace 30 which prevents upward movement of the bottle once it is secured in place. The brace can be a ring structure with an opening 31 through which the bottle is inserted. The opening can be tapered outwardly at the bottom so as to conform generally with the shape of a bottle having an inwardly tapering neck 11. The brace can be of a semi-circular or "C" construction (not shown) so long as the diameter of the opening is greater than the diameter of the bottle opening and less than the widest part of the bottle. The brace has a post 13 which connects with the actuator means 14.

Figure 7:
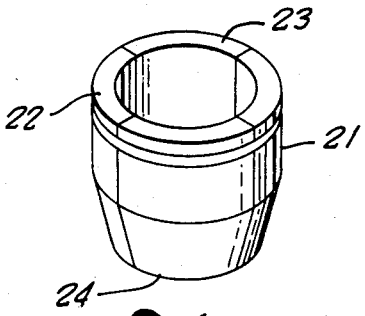
FIG. 7 is a perspective view of the jaws of the chuck of the embodiment of FIG. 1.
Figure 6:
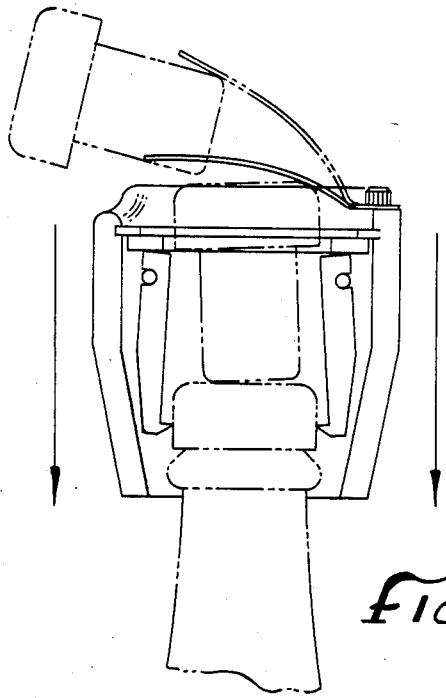
FIG. 6 is a diagrammatic illustration of the embodiment of FIG. 1 showing the stopper being removed from the chuck means after it has been removed from the bottle.

As illustrated in more detail in FIGS. 2 and 7, the chuck has a plurality of circular opposing jaws 21, 22, 23 and 24. A groove 25 is cut in the upper portion of the jaws. A flexible retaining means 33 is inserted into the groove to hold the jaws in a generally circular configuration. The restraining means is an O-ring constructed of a flexible material such as plastic or rubber. The flexible restraining means permits the jaws to move radially with respect to one another.

Preferably, for use on stoppers having a downwardly-facing shoulder, the jaws are provided with an inwardly-protruding annular lip 26 which engages the stopper shoulder. Alternatively, the jaws may have an inner friction surface 45 (shown in FIG. 9) which engages the vertical side of the stopper. The friction surface is particularly useful on stoppers which have a smooth side wall.

A collar 28 encircles the jaws. Movement of the collar over the jaws causes the jaws to urge inwardly to engage the stopper. The inner surface of the collar and the outer surface of each jaw may be tapered for easy movement relative to each other.

The vertical movement of the jaws within the collar is restricted by means of a stop 27. A suitable stop can be a retaining washer, as shown in FIG. 3, which is inserted into a groove 29 cut into the collar and protruding inwardly. Movement can also be restricted by means of an inwardly-protruding annular lip (not shown).

The collar 28 is pivotably connected to the actuator means 14 such as a lever. The lever is pivotably connected at a point along its midsection to the post 13 of the brace 30. At one end, lever 14 is pivotably connected to connecting links 31 and 32, which are in turn pivotably connected to the collar.

Figure 5:
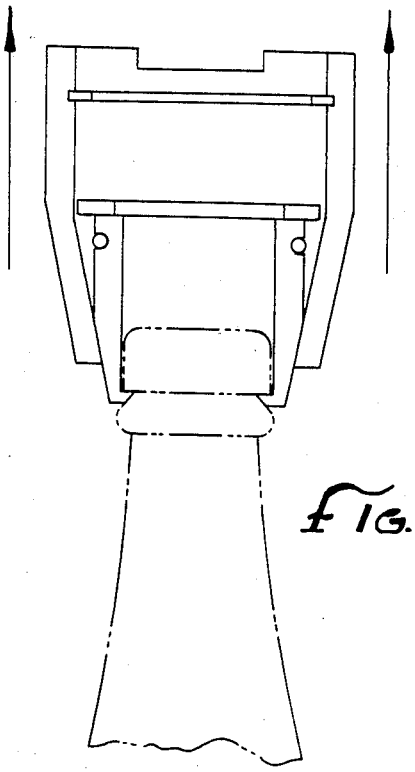
FIG. 5 is a diagrammatic illustration of the embodiment of FIG. 1 showing the chuck engaging the stopper.

In operation, the bottle 10 is first secured against the brace 30. As illustrated diagrammatically in FIGS. 4–6, the chuck 20 is then positioned over the bottle stopper 15 and forcibly lowered. As the leading edge of the jaws engage the stopper, they are forced upwardly until they contact the retaining washer 27 (FIG. 4). The upward movement of the jaws being thus prevented, the jaws are forced radially outwardly, away from each other, and the chuck is allowed to slide further down the stopper (FIG. 5). As the inwardly-protruding annular lips 26 of the jaws reach the stopper shoulder, the flexible retaining means 24 causes them to move radially inwardly to engage the stopper. The collar is then moved upwardly by pushing downwardly on the opposite end of the lever 14. The collar urges the jaws radially inwardly and tightly against the stopper. As the lever is further depressed, the collar is moved further upwardly, and the stopper is thereby moved out of the bottle opening. The stopper 15 remains securely held in place between the jaws and discharge of the stopper as a result of the pressure inside the bottle is thereby prevented.

At large gatherings, where a number of bottles may be opened, another bottle is secured to the brace 30. As the chuck 20 is lowered over the stopper 15 the jaws are once again urged upwardly. As the jaws contact the stop 27 they again move radially outwardly, this time releasing the stopper from the previous bottle out the top of the chuck and simultaneously engaging the new stopper. The remaining steps then continue as before.

Another advantage of the device of the present invention is that the force from the jaws is asserted radially inwardly against the stopper. Thus, as force is applied to the stopper, the stopper does not have a tendency to deform across its diameter, rather it has a tendency to elongate along its axis and decrease in diameter, thereby making the stopper easier to remove.

Figure 8:
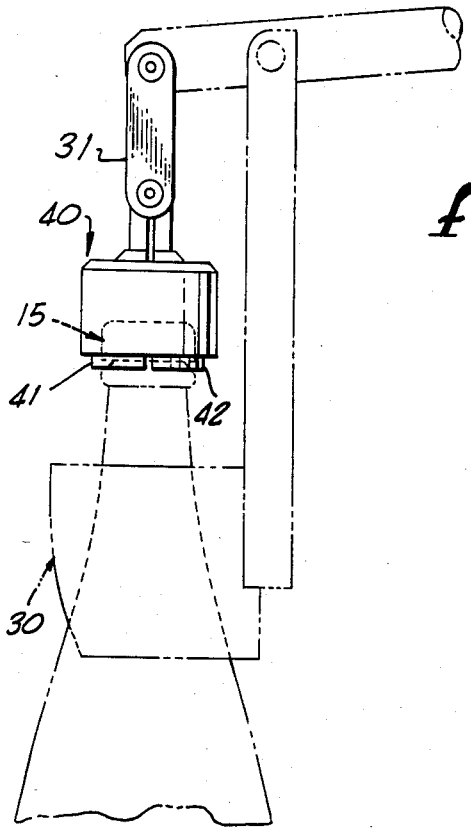
FIG. 8 is a side view of an alternative bottle opener embodiment of the present invention, shown with the opener's chuck engaging the stopper.
Figure 9:
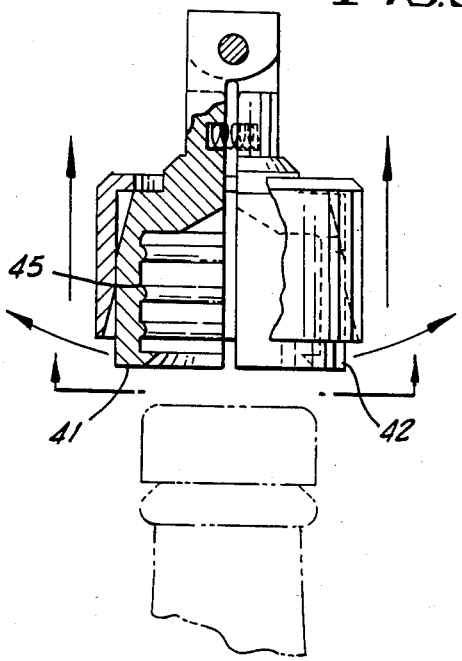
FIG. 9 is an enlarged partial cross-sectional view of the chuck of the embodiment of FIG. 8.
Figure 10:
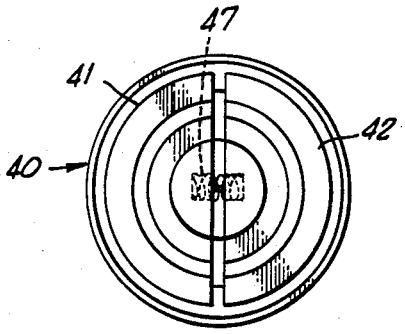
FIG. 10 is a plan view of the chuck of the embodiment shown in FIG. 8.

In another embodiment of the invention, illustrated in FIGS. 8–10, a chuck 40 has a pair of opposing radially moveable jaws 41 and 42. The inner surfaces of the jaws have a friction surface 45 such as a ribbing or knurling in order to securely engage the vertical side of the stopper 15. The jaws may also have an inwardly-protruding annular lip such as that shown in FIG. 2. Each jaw has a lower portion with a semi-circular configuration for engaging the stopper. The upper portion of each jaw is rectangular and pivotably connected to connecting link 31. Connecting link 31 is in turn pivotably connected to the actuator means 14. The collar 48 circularly encloses the two jaws. The inner surface of the collar and the outer surface of the jaws are tapered so that the collar can slide easily over the jaws. The jaws have a spring-loaded pin 47 to cause easy separation when the collar is not slid down in place.

In operation, the bottle is secured in the brace 10 and jaws 41 and 42 are positioned around the stopper. The collar is then slid down over the jaws which urges them inward against the stopper. The chuck is moved upward relative to the brace by depressing the end of the lever 14 opposite to the chuck. As the chuck moves upward the stopper is removed from the bottle. As in the previous embodiment, the stopper is secured firmly in place between the jaws, and discharge of the stopper as a result of the pressure inside the bottle is thereby prevented.

Figure 11:
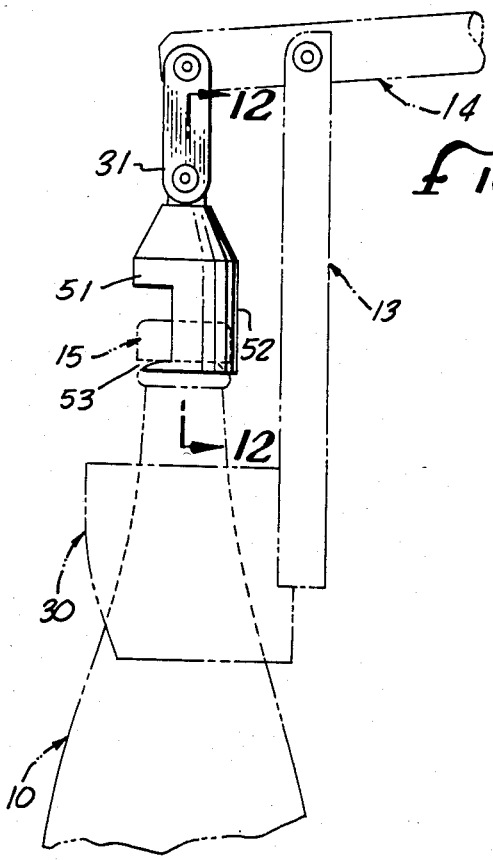
FIG. 11 is a side view of yet another bottle opener embodiment of the present invention, shown with a socket engaging the stopper.
Figure 12:
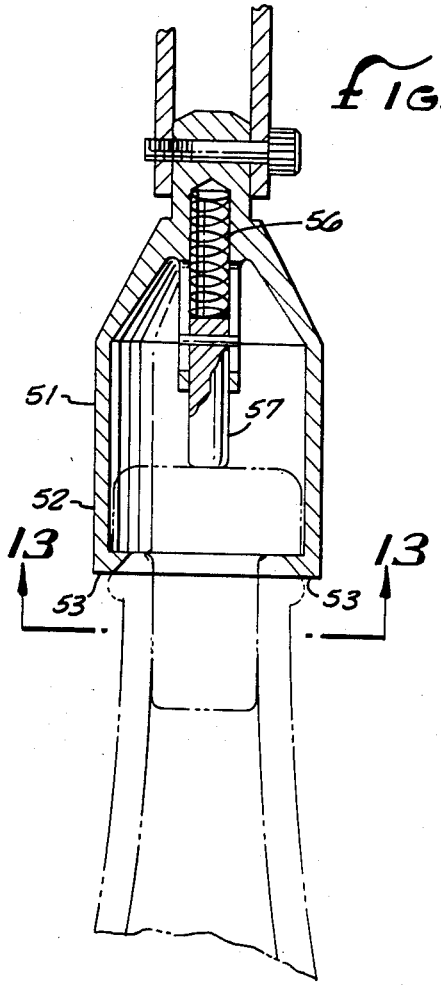
FIG. 12 is a cross-sectional view taken along lines 12—12 in FIG. 11.
Figure 13:
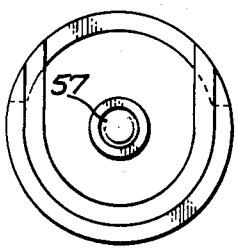
FIG. 13 is a bottom plan view of the socket taken along lines 13—13 in FIG. 12.

In yet another embodiment of the present invention (FIGS. 11–13), a bottle opener specifically designed for opening champagne bottles having a downwardly-facing annular shoulder is provided. The device has a socket 50 with a cylindrical upper portion 51 and semicircular lower portion 52, and an inwardly-protruding annular lip 53 at the bottom. The diameter of the lip is less than the maximum diameter of the stopper. The socket can be pivotably connected to the brace 10 and actuator means 14 of the previous two embodiments.

In operation, the socket 50 is slid around the stopper 15 with the lip 53 engaging the downwardly-facing shoulder of the stopper. The socket is then raised upwardly by pushing downwardly on the lever 14 at the end opposite to the socket, causing the stopper to be removed from the bottle opening. The socket can also contain a spring 56 and pin 57 for pressing downwardly against the top of the stopper so as to prevent the stopper from being discharged out of the socket as the bottle is being opened.

It can be readily appreciated that the invention provides an easily operable device which can controllably remove the stopper from a champagne bottle without allowing the stopper to be discharged from the bottle. The device of the present invention is particularly useful during large events such as weddings or in commercial establishments where a large number of champagne bottles are opened.

While a particular form of the invention has been illustrated and described, it will be apparent that various modifications can be made without departing from the spirit and scope of the invention. Accordingly, the invention is defined only by the following claims.

I claim:

1. A device for removing a stopper protruding upwardly from a bottle comprising:

brace means selectively securable to the bottle at a location beneath the stopper;

chuck means having a plurality of opposing, radially-moveable jaws encircling the stopper and a collar encircling the jaws such that vertical movement of the collar relative to the jaws urges the jaws radially inwardly to engage the bottle stopper; and actuator means operatively connected to the brace means and chuck means for raising the chuck means relative to the brace means and thereby removing the stopper from the bottle.

2. The device of claim 1 wherein:

the stopper has a downwardly-facing annular shoulder; and each of the jaws has an inwardly-protruding annular lip at its lower end for engagement with the stopper shoulder.

3. The device of claim 1 wherein:

the bottle has an inwardly tapered neck; and the brace means has a tapered opening conforming generally with the shape of the bottle neck.

4. The device of claim 1 wherein a portion of the outer surface of the jaws is tapered such that vertical movement of the collar relative to the jaws urges the jaws radially inwardly to engage the bottle stopper.

5. The device of claim 1 wherein the inner surface of the collar is tapered such that vertical movement of the collar relative to the jaws urges the jaws radially inwardly to engage the bottle stopper.

6. The device of claim 1 wherein:

the stopper has a smooth cylindrical side wall; and the inner surface of each jaw has a friction surface which engages the stopper side wall.

7. A device for removing a stopper protruding upwardly from a bottle comprising:

brace means selectively securable to the bottle at a location beneath the bottle stopper;

chuck means having a plurality of radially-moveable opposing jaws encircling the stopper and having tapered outer surfaces, and a collar encircling the jaws and having a portion of its inner surface tapered so that upward movement of the collar relative to the jaws urges the jaws radially inwardly to engage the stopper; and actuator means operatively connected to the brace means and collar for raising the collar relative to the brace means to initially urge the jaws radially inwardly to engage the stopper and to subsequently remove the stopper from the bottle.

8. The device of claim 7 wherein the bottle has an inwardly tapering neck, and the brace means has a tapered opening conforming generally with the shape of the bottle neck.

9. The device of claim 7 wherein:

the stopper has a downwardly-facing annular shoulder; and each of the jaws has an inwardly-protruding annular lip at its lower end for engagement with the stopper shoulder.

10. The device of claim 7 wherein:

the stopper has a smooth cylindrical side wall; and the inner surface of each jaw has a friction surface which engages the stopper side wall.

11. The device of claim 7 wherein the jaws are held in place by flexible restraining means.

12. The device of claim 11 wherein the restraining means is an O-ring constructed of a flexible material.

13. The device of claim 7 wherein the chuck means further includes a stop for limiting upward movement of the jaws relative to the collar.

14. The device of claim 13 wherein the stop is an annular lip protruding inwardly from the collar.

15. The device of claim 13 wherein the stop is a retaining washer secured to the upper portion of the inner surface of the collar.

16. The device of claim 7 wherein the collar is pivotably connected to the actuator means.

17. The device of claim 16 wherein the actuator means includes a lever and a link pivotally connected at one end to the lever and at another end to the collar.

18. The device of claim 7 wherein the actuator means comprises a lever pivotably connected at a point along its midsection to the brace means and pivotably connected to the collar at one end such that downward movement of the lever at the end opposite to the collar raises the collar relative to the brace means, initially urging the jaws radially inwardly to engage the stopper and subsequently removing the stopper from the bottle.

19. A device for removing a stopper protruding upwardly from a bottle, the stopper including a downwardly-facing annular shoulder, the device comprising:

brace means selectively securable to the bottle at a location below the stopper;

chuck means including a plurality of radially-moveable opposing jaws encircling the stopper, each of the jaws having a portion of its outer surface tapered and having an inwardly-protruding lip for engagement with the stopper shoulder, and a collar encircling the jaws and having a portion of its inner surface tapered so that upward movement of the collar relative to the jaws urges the jaws radially upwardly to engage the stopper; and actuator means including a lever pivotably connected at a midpoint to the brace means and pivotably connected at one end to the collar such that downward movement of the lever at the opposite end raises the collar relative to the brace means, to initially urge the jaws radially inwardly to engage the stopper and subsequently remove the stopper from the bottle.

20. A device for removing a stopper protruding upwardly from a bottle, the stopper having a smooth cylindrical side wall, comprising:

brace means selectively securable to the bottle at a location beneath the stopper;

chuck means having two radially-moveable opposing jaws encircling the stopper, each jaw having a friction inner surface and tapered outer surface, and a collar having a tapered inner surface encircling the jaws so that downward movement of the collar over the jaws urges the jaws radially inwardly to engage the stopper side wall; and actuator means for raising the jaws relative to the brace means, the actuator means including a lever pivotably connected at a midpoint to the brace means and at one end to the jaws such that downward movement of the opposite end raises the jaws and thereby removes the stopper from the bottle.

21. A device for removing a stopper protruding upwardly from a bottle, the stopper having a downwardly-facing annular shoulder, comprising:

brace means selectively securable to the bottle at a location beneath the stopper;

a socket having a cylindrical upper portion and a semi-circular lower portion with an inwardly-protruding annular lip, with the diameter of the semi-circular lower portion being less than the maximum diameter of the stopper shoulder such that the lip can engage the stopper shoulder; and actuator means operatively connected to the brace means and the socket, for raising the socket relative to the brace means and thereby removing the stopper from the bottle.

22. The device of claim 21 wherein the bottle has an inwardly tapered neck; and the brace means has a tapered opening conforming generally with the shape of the bottle neck.

23. The device of claim 21 wherein the actuator means comprises a lever pivotably connected at a midpoint to the brace and pivotably connected at one end to the socket such that downward movement of the opposite end of the lever raises the socket relative to the brace means and thereby removes the stopper from the bottle.

* * * * *